US011067910B2

(12) United States Patent
Mori et al.

(10) Patent No.: US 11,067,910 B2
(45) Date of Patent: Jul. 20, 2021

(54) ELECTROPHOTOGRAPHIC PHOTORECEPTOR, PROCESS CARTRIDGE, AND ELECTROPHOTOGRAPHIC APPARATUS

(71) Applicant: CANON KABUSHIKI KAISHA, Tokyo (JP)

(72) Inventors: Haruki Mori, Nagareyama (JP); Koichi Nakata, Tokyo (JP); Shubun Kujirai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/785,333

(22) Filed: Feb. 7, 2020

(65) Prior Publication Data

US 2020/0272065 A1 Aug. 27, 2020

(30) Foreign Application Priority Data

Feb. 27, 2019 (JP) ..... JP2019-034907

(51) Int. Cl.
*G03G 5/147* (2006.01)

(52) U.S. Cl.
CPC ..... *G03G 5/14708* (2013.01); *G03G 5/14726* (2013.01); *G03G 5/14791* (2013.01)

(58) Field of Classification Search
CPC ..... G03G 5/14717; G03G 5/14739; G03G 5/1473; G03G 5/14734; G03G 5/14747
See application file for complete search history.

(56) References Cited

U.S. PATENT DOCUMENTS

2013/0260295 A1* 10/2013 Iwadate ..... G03G 5/0539 430/56
2019/0391504 A1* 12/2019 Nakata ..... G03G 5/0596

FOREIGN PATENT DOCUMENTS

| | | | |
|---|---|---|---|
| JP | 2005-091741 | A | 4/2005 |
| JP | 2009-134002 | A | 6/2009 |
| JP | 2013-44818 | A | 3/2013 |
| JP | 2013-44823 | A | 3/2013 |
| JP | 2016-142915 | A | 8/2016 |

* cited by examiner

*Primary Examiner* — Peter L Vajda
(74) *Attorney, Agent, or Firm* — Canon U.S.A., Inc., IP Division

(57) ABSTRACT

An electrophotographic photoreceptor includes a support, a photosensitive layer, and a protection layer. The protection layer contains a copolymer of a compound having a specific frame and a hole-transporting compound containing a specific polarizable functional group.

8 Claims, 1 Drawing Sheet

ELECTROPHOTOGRAPHIC PHOTORECEPTOR, PROCESS CARTRIDGE, AND ELECTROPHOTOGRAPHIC APPARATUS

BACKGROUND OF THE INVENTION

Field of the Invention

The present disclosure relates to an electrophotographic photoreceptor, a process cartridge including the electrophotographic photoreceptor, and an electrophotographic apparatus.

Description of the Related Art

Electrophotographic photoreceptors mounted in electrophotographic image-forming apparatuses (electrophotographic apparatuses) include organic electrophotographic photoreceptors (hereinafter referred to as "electrophotographic photoreceptors") containing an organic substance that is a photoconductive material (charge generation material) and have been widely investigated.

For example, a reduction in image quality during repetitive use is one of disadvantages in an electrophotographic photoreceptor and has been variously investigated. Japanese Patent Laid-Open No. 2013-44818 (hereinafter referred to as Patent Document 1) and Japanese Patent Laid-Open No. 2013-44823 (hereinafter referred to as Patent Document 2) describe an electrophotographic photoreceptor including a protection layer containing a cured product of a hole-transporting compound containing a polarizable functional group having a specific structure. The electrophotographic photoreceptor exhibits the effect of reducing the deterioration of image quality during repetitive use.

The inventors have carried out intensive investigations and, as a result, have found that the electrophotographic photoreceptor described in each of Patent Documents 1 and 2 has a large difference between electric potential changes during repetitive use depending on a usage environment. In particular, a difference (environmental change) between a high-temperature, high-humidity environment and a low-temperature, low-humidity environment is significant. When an environmental change during repetitive use is large, the change of image density during repetitive use varies depending on a usage environment; hence, upon forming an image, a main body needs to be controlled depending on a usage environment. Therefore, an electrophotographic photoreceptor capable of suppressing an environmental change during repetitive use is desirable.

SUMMARY OF THE INVENTION

Thus, one aspect of the present disclosure is directed to providing an electrophotographic photoreceptor capable of suppressing an environmental change during repetitive use. Furthermore, another aspect of the present disclosure is directed to providing a process cartridge including the electrophotographic photoreceptor and an electrophotographic apparatus.

According to one aspect of the present disclosure, there is provided an electrophotographic photoreceptor including, in series, a support, a photosensitive layer, and a protection layer. The protection layer contains a copolymer of a composition containing a compound represented by the following formula (1) and a compound represented by the following formula (2):

(1)

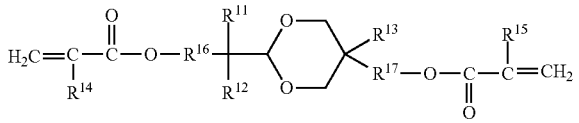

In formula (1), $R^{11}$ and $R^{12}$ each independently represent an alkyl group having one to four carbon atoms or a tertiary butylphenyl group and may be bonded to each other to form a ring, $R^{13}$ represents an alkyl group having one to four carbon atoms, $R^{14}$ and $R^{15}$ each independently represent a hydrogen atom or a methyl group, and $R^{16}$ and $R^{17}$ each independently represent an alkylene group having one to four carbon atoms.

(2)

In formula (2), A represents a hole-transporting group, $P^1$ represents an monovalent functional group represented by the following formula (3) or (4), a represents an integer of 1 to 4, and $P^1$ may represent the same group or different groups when a is an integer of 2 to 4.

(3)

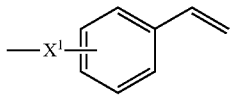

In formula (3), $X^1$ represents a (n+1)valent linking group formed by combining two or more selected from the group consisting of an alkylene group, —C(═O)—, —N(L)-, —S—, and —O— and is bonded to $P^1$ in formula (2) and L represents a hydrogen atom, an alkyl group, an aryl group, or an aralkyl group.

(4)

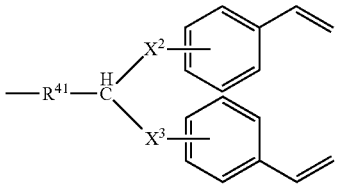

In formula (4), $R^{41}$ represents an alkylene group and is bonded to $P^1$ in formula (2); $X^2$ and $X^3$ represent a (n+1) valent linking group formed by combining two or more selected from the group consisting of an alkylene group, —C(═O)—, —N(L)-, —S—, and —O— and may be the same as or different from each other; and L represents a hydrogen atom, an alkyl group, an aryl group, or an aralkyl group, a compound obtained by substituting a hydrogen atom for a moiety of A that is bonded to $P^1$ in formula (2) being represented by the following formula (5) or (6).

(5)

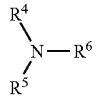

In formula (5), $R^4$, $R^5$, and $R^6$ represent a phenyl group, biphenyl group, or fluorenyl group that may have an alkyl group having one to six carbon atoms and $R^4$, $R^5$, and $R^6$ may be the same as or different from each other.

(6)

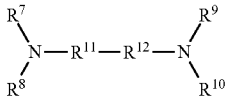

In formula (6), $R^7$, $R^8$, $R^9$, $R^{10}$, $R^{11}$, and $R^{12}$ represent a phenyl group that may have an alkyl group having one to six carbon atoms and $R^7$, $R^8$, $R^9$, $R^{10}$, $R^{11}$, and $R^{12}$ may be the same as or different from each other.

Further features of the present disclosure will become apparent from the following description of exemplary embodiments with reference to the attached drawings.

DESCRIPTION OF THE EMBODIMENTS

Figure 1:
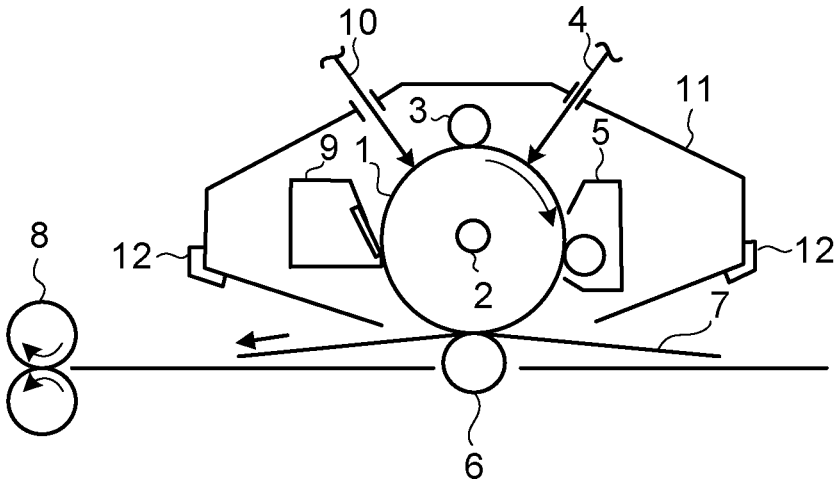
FIG. 1 is an illustration showing an example of the schematic configuration of an electrophotographic apparatus including a process cartridge including an electrophotographic photoreceptor according to an embodiment of the present disclosure.

Embodiments of the present disclosure will now be described.

An electrophotographic photoreceptor according to an embodiment of the present disclosure includes a protection layer containing a copolymer of a composition containing a compound represented by the following formula (1) and a compound represented by the following formula (2):

(1)

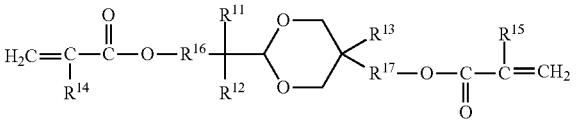

In formula (1), $R^{11}$ and $R^{12}$ each independently represent an alkyl group having one to four carbon atoms or a tertiary butylphenyl group and may be bonded to each other to form a ring, $R^{13}$ represents an alkyl group having one to four carbon atoms, $R^{14}$ and $R^{15}$ each independently represent a hydrogen atom or a methyl group, and $R^{16}$ and $R^{17}$ each independently represent an alkylene group having one to four carbon atoms.

(2)

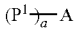

In formula (2), A represents a hole-transporting group, $P^1$ represents an monovalent functional group represented by the following formula (3) or (4), a represents an integer of 1 to 4, and $P^1$ may represents the same group or different groups when a is an integer of 2 to 4.

(3)

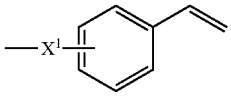

In formula (3), $X^1$ represents a (n+1)valent linking group formed by combining two or more selected from the group consisting of an alkylene group, —C(═O)—, —N(L)-, —S—, and —O— and is bonded to $P^1$ in formula (2) and L represents a hydrogen atom, an alkyl group, an aryl group, or an aralkyl group.

(4)

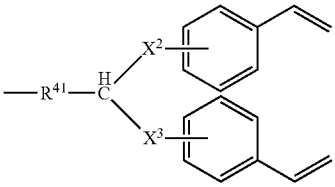

In formula (4), $R^{41}$ represents an alkylene group and is bonded to $P^1$ in formula (2); $X^2$ and $X^3$ represent a (n+1) valent linking group formed by combining two or more selected from the group consisting of an alkylene group, —C(═O)—, —N(L)-, —S—, and —O— and may be the same as or different from each other; and L represents a hydrogen atom, an alkyl group, an aryl group, or an aralkyl group.

Incidentally, a compound obtained by substituting a hydrogen atom for a moiety of A that is bonded to $P^1$ in formula (2) is represented by the following formula (5) or (6).

(5)

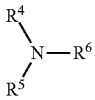

In formula (5), $R^4$, $R^5$, and $R^6$ represent a phenyl group, biphenyl group, or fluorenyl group that may have an alkyl group having one to six carbon atoms and $R^4$, $R^5$, and $R^6$ may be the same as or different from each other.

(6)

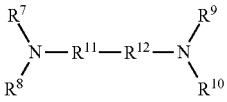

In formula (6), $R^7$, $R^8$, $R^9$, $R^{10}$, $R^{11}$, and $R^{12}$ represent a phenyl group that may have an alkyl group having one to six carbon atoms and $R^7$, $R^8$, $R^9$, $R^{10}$, $R^{11}$, and $R^{12}$ may be the same as or different from each other.

The inventors infer the reason why an effect of the present disclosure is exhibited as described below.

It is inferred that an environmental change during the repetitive use of an electrophotographic photoreceptor is significant when the influence of moisture passing through a protection layer on a charge generation material in a photosensitive layer varies depending on a usage environment. In particular, it is inferred that since the absolute moisture content of a usage environment is significantly different between a high-temperature, high-humidity environment and a low-temperature, low-humidity environment, the influence of moisture on the charge generation material differs and an environmental change during repetitive use is large.

In the electrophotographic photoreceptor described in each of Patent Documents 1 and 2, the protection layer contains the cured product of the hole-transporting compound, which contains the polarizable functional group having the specific structure, and the polarizable functional group having the specific structure has a styrene frame. The styrene frame has a low polymerization rate and it takes a long time to cure the hole transport compound. Therefore, it is conceivable that hole transport moieties are likely to aggregate and a dense structure is likely to be formed in a film. It is conceivable that if a coarse portion is formed in a cured film in the protection layer, then moisture readily passes through the protection layer to reach a charge generation material in a photosensitive layer. It is inferred that an environmental change during repetitive use is significant in the electrophotographic photoreceptor described in each of Patent Documents 1 and 2 because of the above reason.

A form of the electrophotographic photoreceptor according to this embodiment is described below with reference to FIG. 2.

In electrophotographic photoreceptor according to this embodiment, the compound represented by formula (1) below is contained in a surface of the electrophotographic photoreceptor like, for example, the protection layer.

(1)

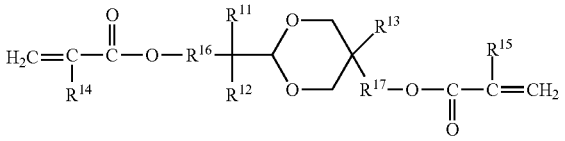

In formula (1), $R^{11}$ and $R^{12}$ each independently represent an alkyl group having one to four carbon atoms or a tertiary butylphenyl group and may be bonded to each other to form a ring, $R^{13}$ represents an alkyl group having one to four carbon atoms, $R^{14}$ and $R^{15}$ each independently represent a hydrogen atom or a methyl group, and $R^{16}$ and $R^{17}$ each independently represent an alkylene group having one to four carbon atoms.

It is inferred that the compound represented by formula (1) has an appropriate molecular weight and size and a film containing the compound represented by formula (1) has increased denseness and has the effect of inhibiting moisture or the like from penetrating into the film from the surroundings. Therefore, in the present disclosure, it is conceivable that the passing of moisture through the protection layer is suppressed and an environmental change can be suppressed, whereas such a hole-transporting compound, containing a polarizable functional group having a styrene frame, as the compound represented by formula (2) is used.

In the compound represented by formula (1), $R^{11}$ and $R^{12}$ are preferably a methyl group. In this case, the compound represented by formula (1) has an appropriate molecular size, a film has increased denseness, and the environmental change can be suppressed.

Examples (Exemplified Compounds 1-1 to 1-20) of the compound represented by formula (1) are cited below. The present invention is not limited to these examples.

Exemplified Compound 1-1

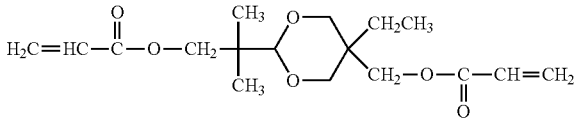

Exemplified Compound 1-2

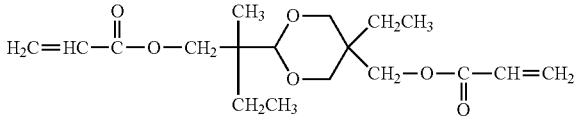

Exemplified Compound 1-3

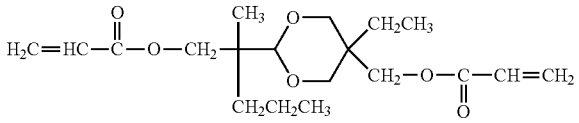

Exemplified Compound 1-4

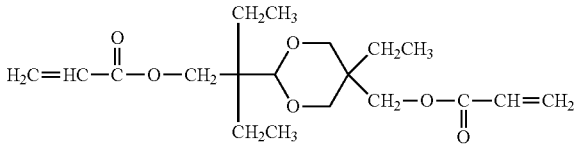

Exemplified Compound 1-5

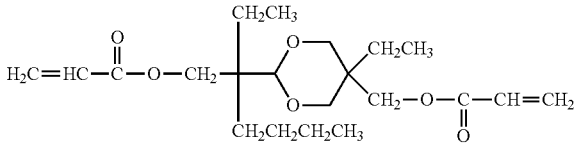

Exemplified Compound 1-6

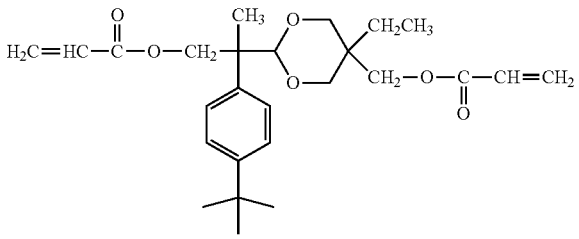

Exemplified Compound 1-7

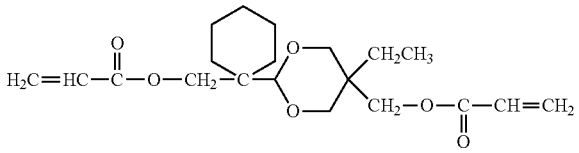

-continued

Exemplified Compound 1-8

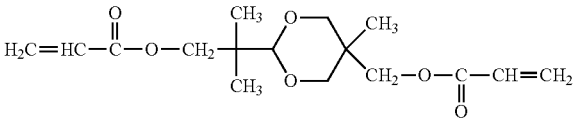

Exemplified Compound 1-9

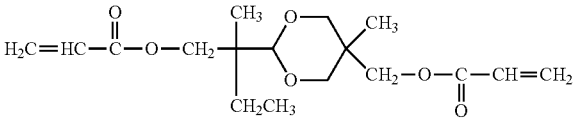

Exemplified Compound 1-10

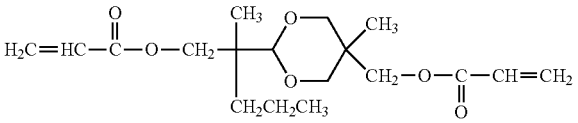

Exemplified Compound 1-11

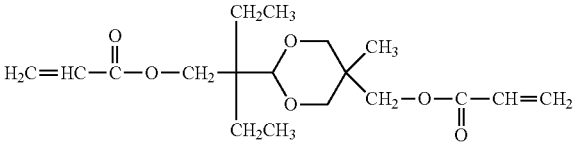

Exemplified Compound 1-12

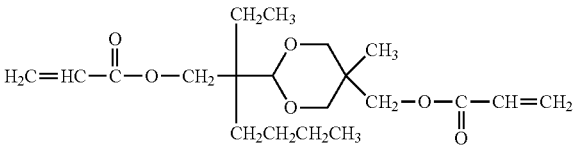

Exemplified Compound 1-13

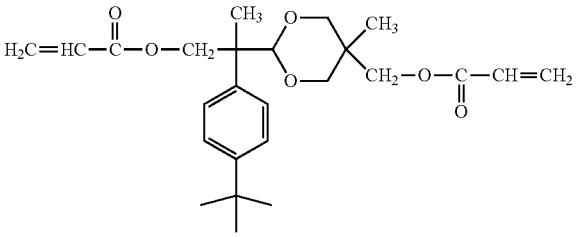

Exemplified Compound 1-14

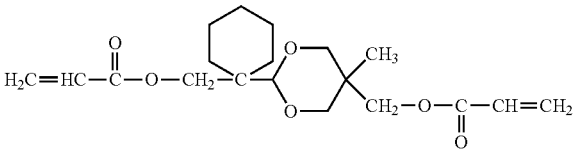

Exemplified Compound 1-15

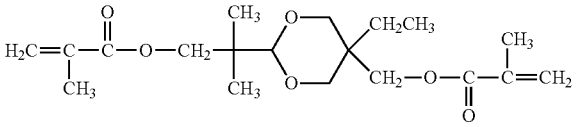

Exemplified Compound 1-16

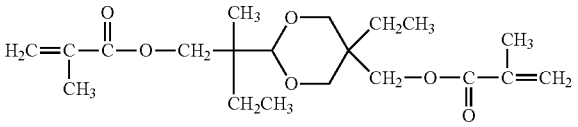

-continued

Exemplified Compound 1-17

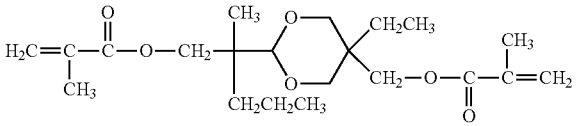

Exemplified Compound 1-18

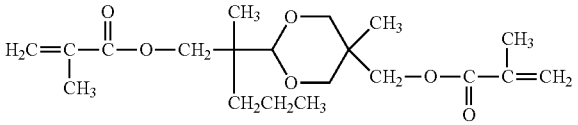

Exemplified Compound 1-19

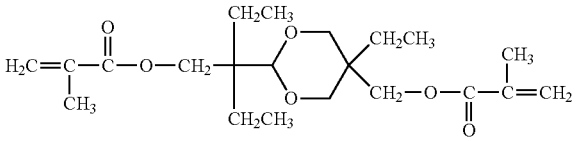

Exemplified Compound 1-20

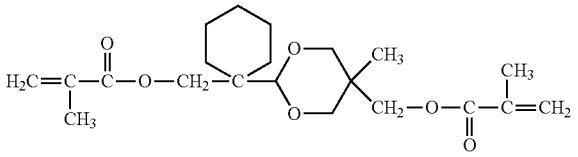

Exemplified Compound 1-21

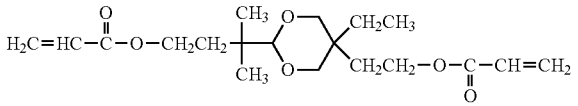

Exemplified Compound 1-22

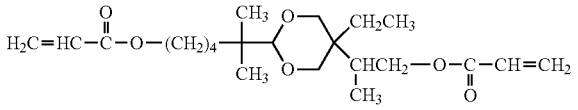

In the compound represented by formula (2), A is the hole-transporting group. The hole-transporting group is a functional group which is a moiety having hole transportability and which contains such a triarylamine frame as represented by formula (5) or such a tetraphenylbenzidine frame as represented by formula (6).

For convenience, a compound obtained by substituting a hydrogen atom for a moiety of A that is bonded to $P^1$ in formula (2) is a compound represented by formula (5) or (6), that is, a compound containing the triarylamine frame or the tetraphenylbenzidine frame.

In the compound represented by formula (2), $P^1$ is represented by formula (3) or (4) and is preferably, for example, a monovalent functional group represented by any one of formulas (7), (8), (9), and (10) below. In this case, the polymerization rate increases to increase the denseness of a film, thereby enabling the environmental change to be suppressed.

(7)

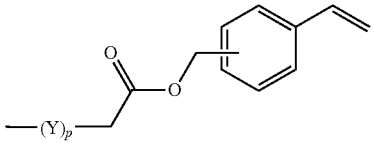

In formula (7), Y represents a divalent organic group and p represents an integer of 0 or 1.

(8)

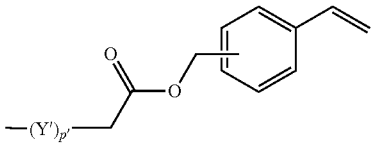

In formula (8), Y' represents a divalent organic group and p' represents an integer of 0 or 1.

(9)

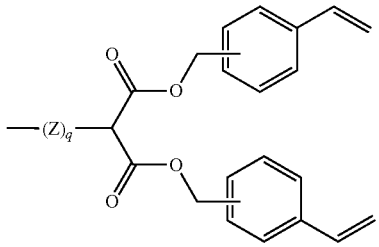

In formula (9), Z represents a divalent organic group and q represents an integer of 0 or 1.

(10)

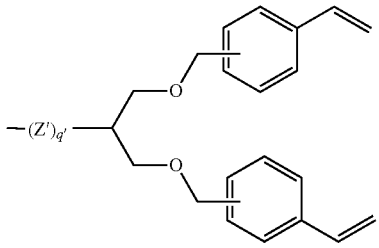

In formula (10), Z' represents a divalent organic group and q' represents an integer of 0 or 1.

Examples (Exemplified Compounds 2-1 to 2-18) of the compound represented by formula (2) are cited below. The present invention is not limited to these examples.

Exemplified Compound 2-1

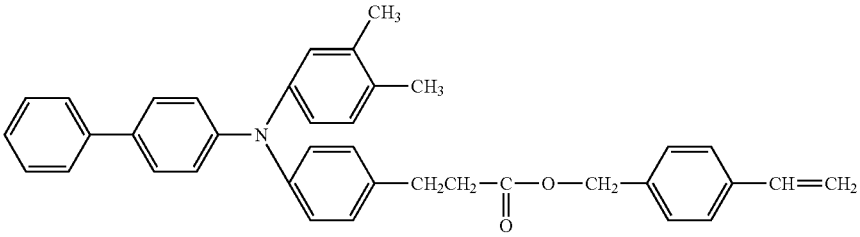

Exemplified Compound 2-2

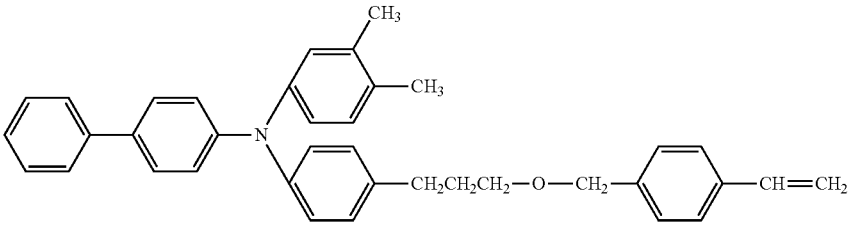

Exemplified Compound 2-3

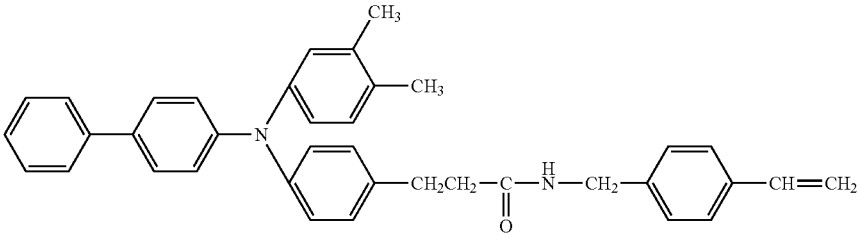

-continued
Exemplified Compound 2-4
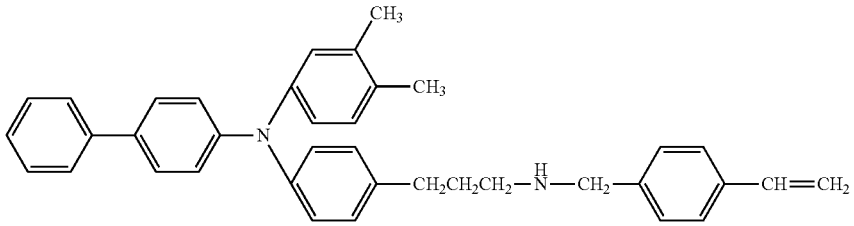
Exemplified Compound 2-5
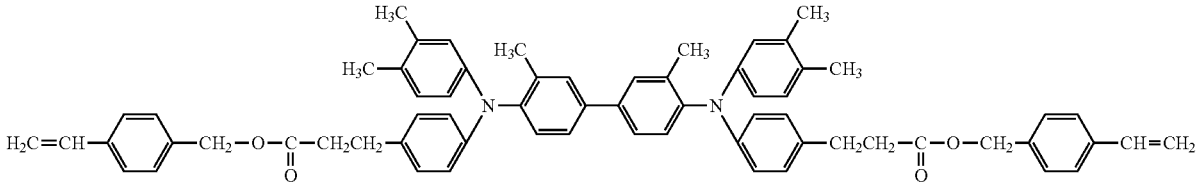
Exemplified Compound 2-6
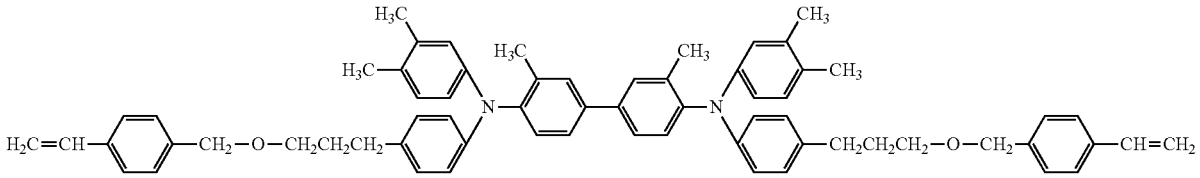
Exemplified Compound 2-7
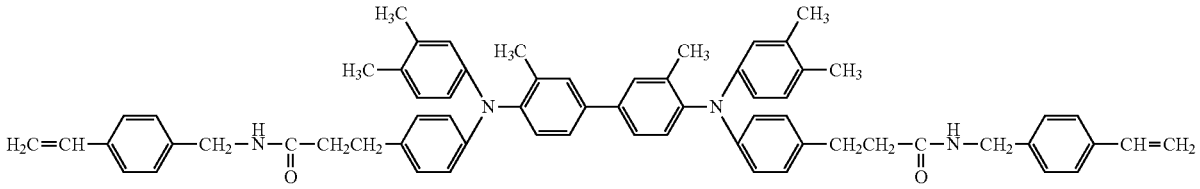
Exemplified Compound 2-8
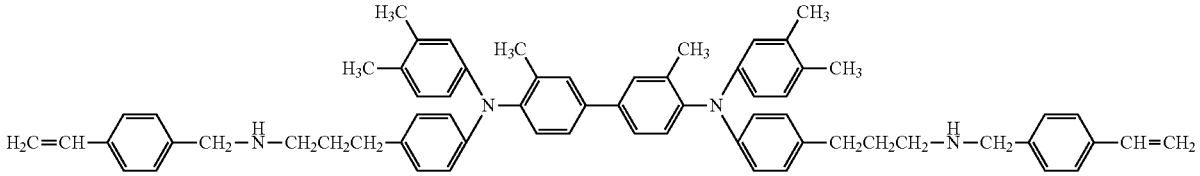
Exemplified Compound 2-9
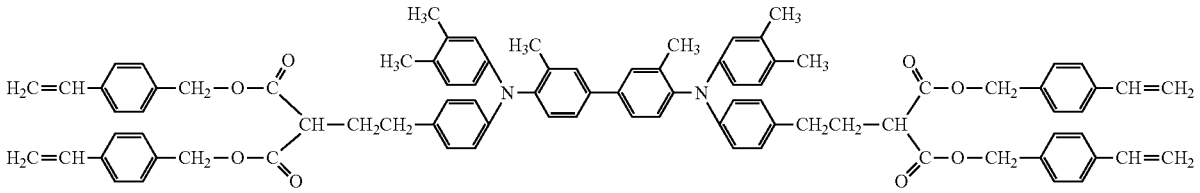
Exemplified Compound 2-10
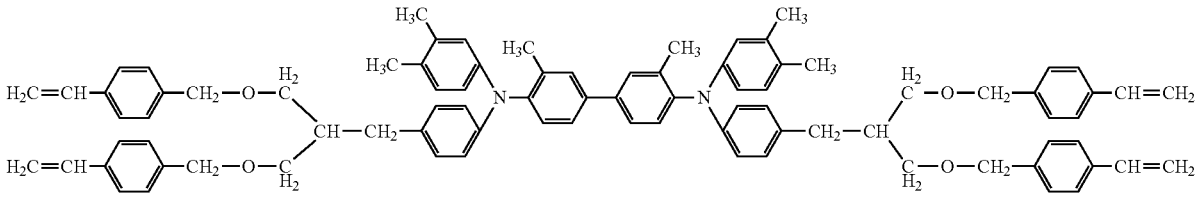

-continued
Exemplified Compound 2-11
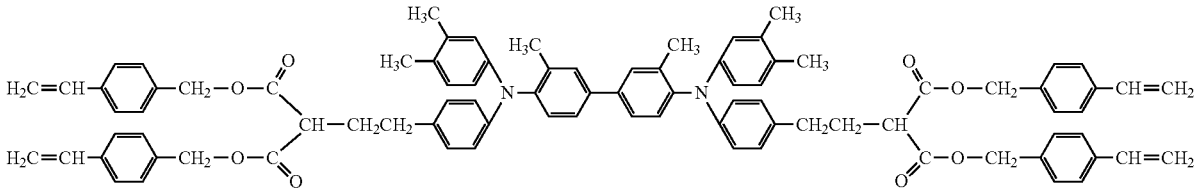
Exemplified Compound 2-12
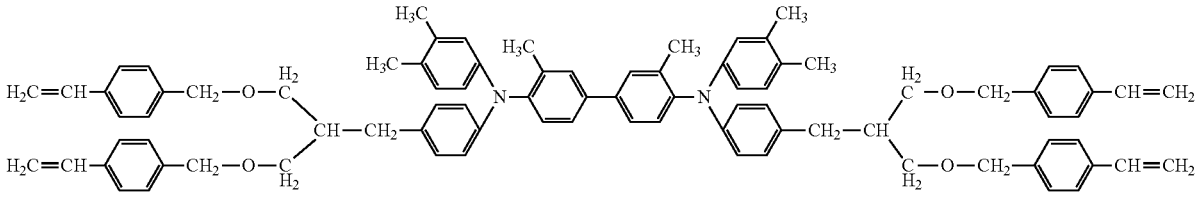
Exemplified Compound 2-13
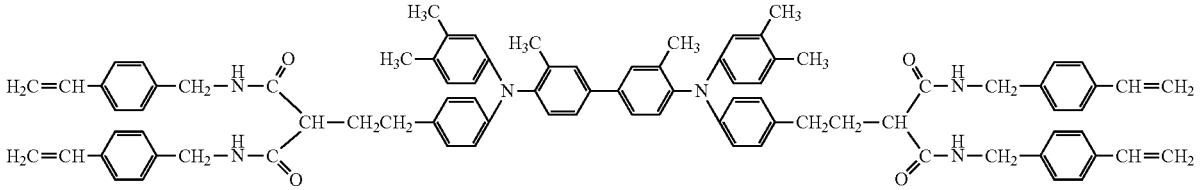
Exemplified Compound 2-14
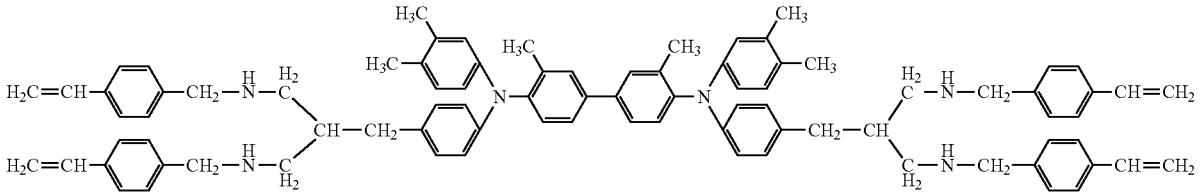
Exemplified Compound 2-15
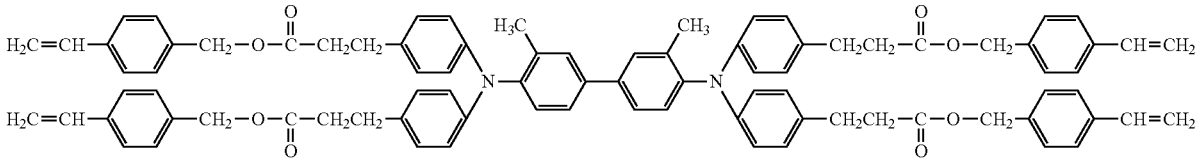
Exemplified Compound 2-16
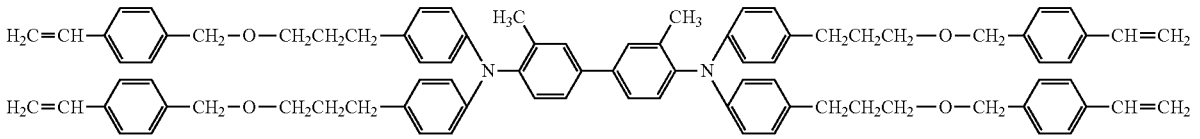
Exemplified Compound 2-17
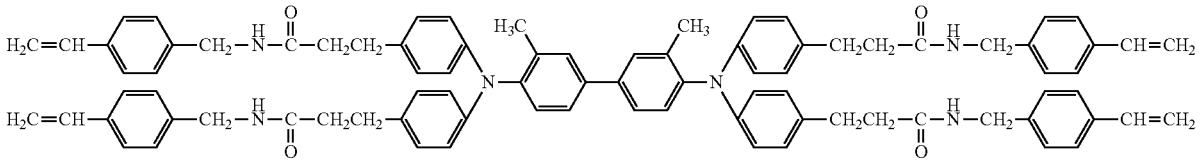
Exemplified Compound 2-18
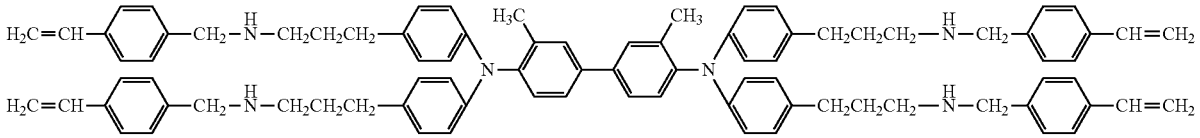

The content of the compound represented by formula (1) in the composition is preferably 25.0% by mass to 66.7% by mass with respect to the content of the compound represented by formula (2). When the content of the compound represented by formula (1) in the composition is more than 66.7% by mass, an electric potential change during repetitive use is large, though the environmental change is suppressed. Thus, when the content of the compound represented by formula (1) in the composition is within this range, both the suppression of the environmental change and the suppression of the electric potential change during repetitive use can be achieved at a high level. The content of the compound represented by formula (1) in the composition is more preferably 33.3% by mass to 53.8% by mass.

The protection layer preferably has an average thickness of 10 μm to 20 μm. It is conceivable that when the thickness of the protection layer is large, the amount of moisture that passes through the protection layer to reach the photosensitive layer is little and therefore the environmental change can be suppressed. When the average thickness of the protection layer is more than 20 μm, the electric potential change during repetitive use is large. Thus, when the average thickness of the protection layer is within this range, both the suppression of the environmental change and the suppression of the electric potential change during repetitive use can be achieved at a high level. The average thickness of the protection layer is more preferably 13 μm to 17 μm.

The protection layer preferably contains polytetrafluoroethylene particles. The polytetrafluoroethylene particles have high hydrophobicity. Therefore, when the protection layer contains the polytetrafluoroethylene particles, the protection layer has increased hydrophobicity. Hence, it is conceivable that the passing of moisture through the protection layer is suppressed and the environmental change can be suppressed.

In the electrophotographic photoreceptor according to this embodiment, the protection layer may contain an additive such as an antioxidant, an ultraviolet absorber, a plasticizer, a leveling agent, a slipperiness-imparting agent, or a wear resistance improver. Examples of the additive include hindered phenol compounds, hindered amine compounds, sulfur compounds, phosphorus compounds, benzophenone compounds, silicone oil, fluorocarbon resin particles, polystyrene particles, polyethylene particles, silica particles, alumina particles, and boron nitride particles.

When the protection layer contains the additive, the content of the additive in the composition of the protection layer is preferably 50% by mass or less.

In the electrophotographic photoreceptor according to this embodiment, the protection layer can be formed through a step of preparing a protection layer coating solution containing the compound represented by formula (1) and the compound represented by formula (2), a step of forming a coating film of the protection layer coating solution, and a step of curing the coating film to form the protection layer.

A solvent used to prepare the protection layer coating solution is preferably one not dissolve a layer placed under the protection layer and is more preferably an alcoholic solvent such as methanol, ethanol, propanol, isopropanol, 1-butanol, 2-butanol, 1-methoxy-2-propanol, or cyclopentanol.

Examples of a method for applying the protection layer coating solution include dip coating, spray coating, ink jet coating, roll coating, die coating, blade coating, curtain coating, wire-bar coating, and ring coating. Among these, dip coating is preferably used from the viewpoint of efficiency and productivity.

A method for curing the coating film of the protection layer coating solution is a curing method using heat, an ultraviolet ray, or an electron beam. In order to suppress the occurrence of unevenness or wrinkles in a film, the coating film of the protection layer coating solution is preferably cured with heat because the polymerization rate is readily adjusted.

The configuration of the electrophotographic photoreceptor according to this embodiment is described below. Components of the electrophotographic photoreceptor are described together with a method for manufacturing the electrophotographic photoreceptor.

Electrophotographic Photoreceptor

The electrophotographic photoreceptor according to this embodiment includes, in series, a support, a photosensitive layer, and a surface layer (protection layer).

Figure 2:
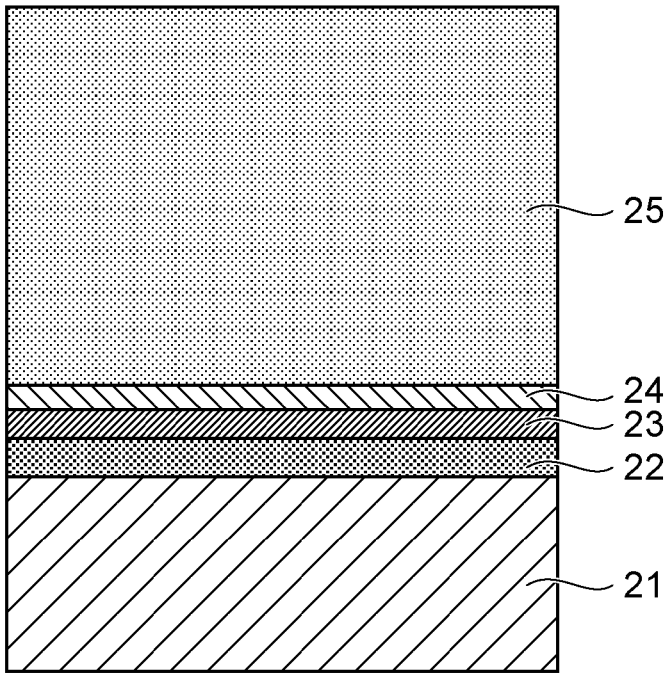
FIG. 2 is an illustration showing an example of the layer configuration of the electrophotographic photoreceptor shown in FIG. 1.

FIG. 2 is an illustration showing an example of the layer configuration of the electrophotographic photoreceptor. Referring to FIG. 2, the electrophotographic photoreceptor includes a support 21, an undercoat layer 22, a charge generation layer 23, a charge transport layer 24, and a protection layer 25. In this case, the charge generation layer 23 and the charge transport layer 24 form the photosensitive layer and the protection layer 25 is the surface layer.

An example of the method for manufacturing the electrophotographic photoreceptor is a method in which coating solutions for layers below are prepared, are applied in a desired order of the layers, and are then dried. A coating method used in this operation may be a method cited in the method for applying the surface layer coating solution and is preferably dip coating from the viewpoint of efficiency and productivity.

The support 21 and layers are described below.

Support

The electrophotographic photoreceptor according to this embodiment includes the support 21. The support 21 is preferably a conductive support having conductivity. Examples of the shape of the support 21 include a cylindrical shape, a belt shape, and a sheet shape. In particular, the support 21 is preferably cylindrical in shape. A surface of the support 21 may be subjected to electrochemical treatment such as anodic oxidation, blasting, or cutting.

The support 21 is preferably made of metal, resin, glass, or the like.

Examples of the metal include aluminium, iron, nickel, copper, gold, stainless steel, and alloys thereof. In particular, the support 21 is preferably an aluminium support made of aluminium.

Resin or glass may be mixed or covered with a conductive material so as to have conductivity.

Conductive Layer

In this embodiment, a conductive layer may be placed on the support 21. Placing the conductive layer on the support 21 enables surface scratches or concavities and convexities of the support 21 to be hidden and the reflection of light on a surface of the support 21 to be controlled.

The conductive layer preferably contains conductive particles and resin.

The conductive particles are preferably made of a metal oxide, metal, carbon black, or the like.

Examples of the metal oxide include zinc oxide, aluminium oxide, indium oxide, silicon oxide, zirconium oxide, tin oxide, titanium oxide, magnesium oxide, antimony oxide, and bismuth oxide. Examples of the metal include aluminium, nickel, iron, nichrome, copper, zinc, and silver.

In particular, the conductive particles are preferably made of the metal oxide and more preferably titanium oxide, tin oxide, or zinc oxide.

When the conductive particles are made of the metal oxide, the surfaces of the conductive particles may be treated with a silane coupling agent or the metal oxide may be doped with an element such as phosphorus or aluminium or an oxide thereof.

The conductive particles may have a layered structure having a core particle and a cover layer covering the core particle. The core particle may be made of titanium oxide, barium sulfate, zinc oxide, or the like. The cover layer may be made of a metal oxide such as tin oxide.

When the conductive particles are made of the metal oxide, the conductive particles preferably have a volume-average particle size of 1 nm to 500 nm and more preferably 3 nm to 400 nm.

Examples of the resin that is preferably contained in the conductive layer include polyester resins, polycarbonate resins, polyvinyl acetal resins, acrylic resins, silicone resins, epoxy resins, melamine resins, polyurethane resins, phenol resins, and alkyd resins.

The conductive layer may contain an opacifying agent such as silicone oil, a resin powder, or titanium oxide.

The conductive layer preferably has an average thickness of 1 μm to 50 μm and more preferably 3 μm to 40 μm.

The conductive layer can be formed in such a manner that a conductive layer coating solution containing the above materials and a solvent is prepared and a coating film of the conductive layer coating solution is formed and is then dried. Examples of the solvent contained in the conductive layer coating solution include alcoholic solvents, sulfoxide solvents, ketone solvents, ether solvents, ester solvents, and aromatic hydrocarbon solvents. An example of a method for dispersing the conductive particles in the conductive layer coating solution is a method using a paint shaker, a sand mill, a ball mill, or a liquid collision-type high-speed disperser.

Undercoat Layer

In this embodiment, the undercoat layer 22 may be placed on the support 21 or the conductive layer. Placing the undercoat layer 22 on the support 21 or the conductive layer increases an interlayer adhesion function and enables a charge injection inhibition function to be imparted.

The undercoat layer 22 preferably contains resin. The undercoat layer 22 may be formed in the form of a cured film in such a manner that a composition containing a monomer having a polarizable functional group is polymerized.

Examples of the resin that is preferably contained in the undercoat layer 22 include polyester resins, polycarbonate resins, polyvinyl acetal resins, acrylic resins, epoxy resins, melamine resins, polyurethane resins, phenol resins, polyvinylphenol resins, alkyd resins, polyvinyl alcohol resins, polyethylene oxide resins, polypropylene oxide resins, polyamide resins, polyamic acid resins, polyimide resins, polyamideimide resins, and cellulose resins.

Examples of the polarizable functional group contained in the monomer having the polarizable functional group include an isocyanate group, a blocked isocyanate group, a methylol group, an alkylated methylol group, an epoxy group, a metal alkoxide group, a hydroxy group, an amino group, a carboxy group, a thiol group, a carboxylic acid anhydride group, and a carbon-carbon double bond group.

The undercoat layer 22 may further contain an electron transport material, a metal oxide, metal, or a conductive polymer for the purpose of enhancing electrical characteristics. In particular, the undercoat layer 22 preferably contains the electron transport material or the metal oxide.

Examples of the electron transport material include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, and boron-containing compounds. The electron transport material used may be an electron-transporting material having a polymerizable functional group. The undercoat layer 22 may be formed in the form of a cured film in such a manner that the electron-transporting material having the polymerizable functional group is copolymerized with the monomer having the polarizable functional group.

Examples of the metal oxide include indium tin oxide, tin oxide, indium oxide, titanium oxide, zinc oxide, aluminium oxide, and silicon oxide. Examples of the metal that may be contained in the undercoat layer 22 include gold, silver, and aluminium.

The undercoat layer 22 may further contain an additive.

The undercoat layer 22 preferably has an average thickness of 0.1 μm to 50 μm, more preferably 0.2 μm to 40 μm, and further more preferably 0.3 μm to 30 μm.

The undercoat layer 22 can be formed in such a manner that an undercoat layer coating solution containing the above materials and a solvent is prepared and a coating film of the undercoat layer coating solution is formed and is then dried and/or cured. Examples of the solvent contained in the undercoat layer coating solution include alcoholic solvents, ketone solvents, ether solvents, ester solvents, and aromatic hydrocarbon solvents.

Photosensitive Layer

The photosensitive layer of the electrophotographic photoreceptor is mainly classified into (1) a multi-layer photosensitive layer and (2) a single-layer photosensitive layer. (1) The multi-layer photosensitive layer includes a charge generation layer containing a charge generation material and a charge transport layer containing a charge transport material. (2) The single-layer photosensitive layer is a photosensitive layer containing both a charge generation material and a charge transport material.

(1) Multi-Layer Photosensitive Layer

The multi-layer photosensitive layer includes the charge generation layer and the charge transport layer.

(1-1) Charge Generation Layer

The charge generation layer preferably contains resin in addition to the charge generation material.

Examples of the charge generation material include azo pigments, perylene pigments, polycyclic quinone pigments, indigo pigments, and phthalocyanine pigments. Among these, the azo pigments and the phthalocyanine pigments are preferable. Among the phthalocyanine pigments, an oxytitanium phthalocyanine pigment, a chlorogallium phthalocyanine pigment, and a hydroxygallium phthalocyanine pigment are preferable.

The content of the charge generation material in the charge generation layer is preferably 40% by mass to 85% by mass with respect to the total mass of the charge generation layer and more preferably 60% by mass to 80% by mass.

Examples of the resin that is preferably contained in the charge generation layer include polyester resins, polycarbonate resins, polyvinyl acetal resins, polyvinyl butyral resins, acrylic resins, silicone resins, epoxy resins, melamine resins, polyurethane resins, phenol resins, polyvinyl alcohol resins, cellulose resins, polystyrene resins, polyvinyl acetate resins, and polyvinyl chloride resins. Among these, the polyvinyl butyral resins are preferable.

The charge generation layer may further contain an additive such as an antioxidant or an ultraviolet absorber. Examples of the additive include hindered phenol compounds, hindered amine compounds, sulfur compounds, phosphorus compounds, and benzophenone compounds.

The charge generation layer preferably has an average thickness of 0.1 μm to 1 μm and more preferably 0.15 μm to 0.4 μm.

The charge generation layer can be formed in such a manner that a charge generation layer coating solution containing the above materials and a solvent is prepared and a coating film of the charge generation layer coating solution is formed and is then dried. Examples of the solvent contained in the charge generation layer coating solution include alcoholic solvents, sulfoxide solvents, ketone solvents, ether solvents, ester solvents, and aromatic hydrocarbon solvents.

(1-2) Charge Transport Layer

The charge transport layer preferably contains resin in addition to the charge transport material.

Examples of the charge transport material include polycyclic aromatic compounds, heterocyclic compounds, hydrazone compounds, styryl compounds, enamine compounds, benzidine compounds, triarylamine compounds, and resins having groups derived from these compounds. Among these, the triarylamine compounds and the benzidine compounds are preferable.

The content of the charge transport layer in the charge transport layer is preferably 25% by mass to 70% by mass with respect to the total mass of the electrolyte layer and more preferably 30% by mass to 55% by mass.

Examples of the resin that is preferably contained in the charge transport layer include polyester resins, polycarbonate resins, acrylic resins, and polystyrene resins. Among these, the polycarbonate resins and the polyester resins are preferable. The polyester resins are preferably polyallylate resins.

The content ratio of the charge transport material to the resin that is preferably contained in the charge transport layer is preferably 4:10 to 20:10 and more preferably 5:10 to 12:10.

The charge transport layer may contain an additive such as an antioxidant, an ultraviolet absorber, a plasticizer, a leveling agent, a slipperiness-imparting agent, or a wear resistance improver. Examples of the additive include hindered phenol compounds, hindered amine compounds, sulfur compounds, phosphorus compounds, benzophenone compounds, siloxane-modified resins, silicone oil, fluorocarbon resin particles, polystyrene particles, polyethylene particles, silica particles, alumina particles, and boron nitride particles.

The charge transport layer preferably has an average thickness of 5 μm to 50 μm, more preferably 8 μm to 40 μm, and further more preferably 10 μm to 30 μm.

The charge transport layer can be formed in such a manner that a charge transport layer coating solution containing the above materials and a solvent is prepared and a coating film of the charge transport layer coating solution is formed and is then dried. Examples of the solvent contained in the charge transport layer coating solution include alcoholic solvents, ketone solvents, ether solvents, ester solvents, and aromatic hydrocarbon solvents.

Among these solvents, the ether solvents or the aromatic hydrocarbon solvents are preferable.

(2) Single-Layer Photosensitive Layer

The single-layer photosensitive layer can be formed in such a manner that a photosensitive layer coating solution containing a charge generation material, a charge transport material, resin, and a solvent is prepared and a coating film of the photosensitive layer coating solution is formed and is then dried. The charge generation material, the charge transport material, and the resin are the same as the materials exemplified in "(1) Multi-layer Photosensitive Layer".

The single-layer photosensitive layer preferably has an average thickness of 5 μm to 50 μm, more preferably 8 μm to 40 μm, and further more preferably 10 μm to 30 μm.

Protection Layer

The protection layer 25 can be formed through a step of preparing the protection layer coating solution, a step of forming a coating film of the protection layer coating solution, and a step of curing the coating film.

Process Cartridge and Electrophotographic Apparatus

A process cartridge according to an embodiment of the present disclosure integrally supports the electrophotographic photoreceptor according to the above embodiment and at least one selected from the group consisting of a charging unit, a developing unit, and a cleaning unit and is attachable to or detachable from a main body of an electrophotographic apparatus.

An electrophotographic apparatus according to an embodiment of the present disclosure includes the electrophotographic photoreceptor according to the above embodiment and at least one selected from the group consisting of a charging unit, an exposure unit, a developing unit, and a transfer unit.

FIG. 1 shows the schematic configuration of an electrophotographic image-forming apparatus that is an example of the electrophotographic apparatus and that includes the process cartridge, which includes the electrophotographic photoreceptor.

A cylindrical electrophotographic photoreceptor 1 is rotationally driven about a shaft 2 placed in the electrophotographic photoreceptor 1 at a predetermined circumferential velocity in an arrow direction. The curved surface of the electrophotographic photoreceptor 1 is charged to a predetermined positive or negative potential by a charging unit 3. Referring to FIG. 1, a roller charging type with a roller charging member is shown. However, a charging type such as a corona charging type, a proximity charging type, or an injection charging type may be used. The charged curved surface of the electrophotographic photoreceptor 1 is irradiated with exposure light 4 from an exposure unit (not shown), whereby an electrostatic latent image corresponding to target image information is formed. The electrostatic latent image formed on the curved surface of the electrophotographic photoreceptor 1 is developed with toner accommodated in a developing unit 5, whereby a toner image is formed on the curved surface of the electrophotographic photoreceptor 1. The toner image formed on the curved surface of the electrophotographic photoreceptor 1 is transferred to a transfer medium 7 with a transfer unit 6. The transfer medium 7 provided with the toner image is conveyed to a fixing unit 8. The toner image is fixed and is then printed out outside the electrophotographic apparatus. The electrophotographic apparatus may include a cleaning unit 9 for removing deposits, such as toner, remaining on the curved surface of the electrophotographic photoreceptor 1 after transferring. A so-called cleanerless system removing the deposits using the developing unit 5 or the like may be used without using the cleaning unit 9. The electrophotographic apparatus may include a charge-eliminating mechanism charge-eliminating the curved surface of the electrophotographic photoreceptor 1 with pre-exposure light 10 from a pre-exposure unit (not shown). The electrophotographic apparatus may include a guiding unit 12, such as a rail for attaching a process cartridge 11 according to an embodiment of the present disclosure to a main body of the electrophotographic apparatus or detaching the process cartridge 11 from the main body thereof.

The electrophotographic photoreceptor according to the above embodiment can be used in a laser beam printer, an LED printer, a copier, a facsimile, and a multifunction apparatus of these.

EXAMPLES

The present disclosure is further described below in detail with reference to examples and comparative examples. The present invention is not in any way limited by the examples without departing from the gist thereof. In the examples, "parts" are on a mass basis unless otherwise specified.

Example 1

An aluminium cylinder having a diameter of 30 mm, a length of 340 mm, and a thickness of 1 mm was used as a support (conductive support).

Next, 100 parts of zinc oxide particles having a specific surface area of 15 $m^2/g$ and an average size of 70 nm were mixed with 500 parts of toluene. To the mixture, 1.3 parts of a silane coupling agent, KBM 503, available from Shin-Etsu Chemical Co., Ltd. was added, followed by agitation for two hours. Thereafter, toluene was distilled off at a reduced pressure, followed by drying by heating at 120° C. for three hours, whereby the surface-treated zinc oxide particles were obtained.

Next, 110 parts of the surface-treated zinc oxide particles were mixed with 500 parts of tetrahydrofuran. A solution prepared by dissolving 0.6 parts of alizarin in 50 parts of tetrahydrofuran was added to this mixture, followed by agitation at 50° C. for five hours. Thereafter, the zinc oxide particles provided with alizarin were filtered out by vacuum filtration, followed by vacuum drying at 60° C., whereby the zinc oxide particles provided with alizarin were obtained.

Next, 60 parts of the zinc oxide particles provided with alizarin; 38 parts of a liquid prepared by mixing 15 parts of a polyvinyl butyral resin, S-LEC BM-1, available from Sekisui Chemical Co., Ltd., serving as a polyol resin and 13.5 parts of a blocked isocyanate, Sumidur 3175, available from Sumika Covestro Urethane Co., Ltd. with 85 parts of methyl ethyl ketone; and 25 parts of methyl ethyl ketone were mixed together, followed by dispersing in a sand mill containing glass beads with a diameter of 1 mmϕ for two hours. To the obtained dispersion, 0.005 parts of dioctyltin laurate serving as a catalyst and 40 parts of silicone resin particles, Tospearl 145, available from GE Toshiba Silicone Co., Ltd. were added, whereby an undercoat layer coating solution was prepared.

The undercoat layer coating solution was applied to the aluminium cylinder by dipping, whereby a coating film was formed. The obtained coating film was dried at 170° C. for 40 minutes, whereby an undercoat layer with a thickness of 20 μm was formed.

Next, hydroxygallium phthalocyanine having diffraction peaks at Bragg angles (2θ±0.2°) of 7.3°, 16.0°, 24.9°, and 28.0° in Cu Kα characteristic X-ray diffraction was prepared as a charge generation material. A mixture containing 15 parts of the hydroxygallium phthalocyanine; ten parts of a vinyl chloride-vinyl acetate copolymer resin, VMCH, available from Nippon Unicar Co., Ltd.; and 200 parts of n-butyl acetate was dispersed in a sand mill containing glass beads with a diameter of 1 mmϕ for four hours. To the obtained dispersion, 175 parts of n-butyl acetate and 180 parts of methyl ethyl ketone were added, whereby a charge generation layer coating solution was prepared. The charge generation layer coating solution was applied to the undercoat layer by dipping, whereby a coating film was formed. The obtained coating film was dried at 100° C. for five minutes, whereby a charge generation layer with a thickness of 0.2 μm was formed.

Next, 45 parts of N,N'-diphenyl-N,N'-bis(3-methylphenyl)-[1,1']biphenyl-4,4'-diamine serving as a charge transport material and 55 parts of a bisphenol Z polycarbonate resin, PCZ 500, having a viscosity-average molecular weight of 50,000, serving as a binding resin were added to 800 parts of chlorobenzene and were dissolved therein, whereby a charge transport layer coating solution was prepared. The charge transport layer coating solution was applied to the charge generation layer by dipping, whereby a coating film was formed. The obtained coating film was dried at 130° C. for 45 minutes, whereby a charge transport layer with a thickness of 20 μm was formed.

Next, 60 parts of polytetrafluoroethylene particles, Lubron L-2, available from Daikin Industries, Ltd.; three parts of a fluorine-containing resin, GF 300, available from Toagosei Co., Ltd.; and 140 parts of cyclopentanol were mixed together, followed by dispersing using an ultra-high speed disperser, whereby a protection layer dispersion was prepared. Next, 21 parts of Exemplified Compound 1-1 serving as a compound represented by formula (1); 49 parts of Exemplified Compound 2-15 serving as a compound represented by formula (2); and one part of a polymerization initiator, OTazo-15, available from Otsuka Chemical Co., Ltd. were dissolved in 80 parts of cyclopentanol, followed by mixing with 100 parts of the protection layer dispersion, whereby a protection layer coating solution was prepared. The protection layer coating solution was applied to the charge transport layer by dipping, whereby a coating film was formed. After the coating film was air-dried at room temperature (25° C.) for 30 minutes, the coating film was cured by heating at 150° C. for 45 minutes in a nitrogen atmosphere with an oxygen concentration of 200 ppm, whereby a protection layer with a thickness of 15 μm was formed.

In this manner, an electrophotographic photoreceptor was manufactured.

Example 2

An electrophotographic photoreceptor was manufactured in substantially the same manner as that used in Example 1 except that a protection layer coating solution was prepared using Exemplified Compound 2-17 instead of Exemplified Compound 2-15.

Example 3

An electrophotographic photoreceptor was manufactured in substantially the same manner as that used in Example 1 except that a protection layer coating solution was prepared using 14 parts of Exemplified Compound 1-1 and 56 parts of Exemplified Compound 2-15 instead of 21 parts of Exemplified Compound 1-1 and 49 parts of Exemplified Compound 2-15.

Example 4

An electrophotographic photoreceptor was manufactured in substantially the same manner as that used in Example 1 except that a protection layer coating solution was prepared using 28 parts of Exemplified Compound 1-1 and 42 parts of Exemplified Compound 2-15 instead of 21 parts of Exemplified Compound 1-1 and 49 parts of Exemplified Compound 2-15.

Example 5

An electrophotographic photoreceptor was manufactured in substantially the same manner as that used in Example 1 except that a protection layer coating solution was prepared using 13 parts of Exemplified Compound 1-1 and 57 parts of Exemplified Compound 2-15 instead of 21 parts of Exemplified Compound 1-1 and 49 parts of Exemplified Compound 2-15.

Example 6

An electrophotographic photoreceptor was manufactured in substantially the same manner as that used in Example 1 except that a protection layer coating solution was prepared using 29 parts of Exemplified Compound 1-1 and 41 parts of Exemplified Compound 2-15 instead of 21 parts of Exemplified Compound 1-1 and 49 parts of Exemplified Compound 2-15.

Example 7

An electrophotographic photoreceptor was manufactured in substantially the same manner as that used in Example 1 except that a protection layer coating solution was prepared using Exemplified Compound 1-4 instead of Exemplified Compound 1-1.

Example 8

An electrophotographic photoreceptor was manufactured in substantially the same manner as that used in Example 1 except that a protection layer coating solution was prepared using 25 parts of cyclopentanol instead of 100 parts of the protection layer coating solution.

Example 9

An electrophotographic photoreceptor was manufactured in substantially the same manner as that used in Example 8 except that a protection layer coating solution was prepared using 13 parts of Exemplified Compound 1-1 and 57 parts of Exemplified Compound 2-15 instead of 21 parts of Exemplified Compound 1-1 and 49 parts of Exemplified Compound 2-15.

Example 10

An electrophotographic photoreceptor was manufactured in substantially the same manner as that used in Example 8 except that a protection layer coating solution was prepared using 29 parts of Exemplified Compound 1-1 and 41 parts of Exemplified Compound 2-15 instead of 21 parts of Exemplified Compound 1-1 and 49 parts of Exemplified Compound 2-15.

Example 11

An electrophotographic photoreceptor was manufactured in substantially the same manner as that used in Example 1 except that a protection layer was formed so as to have a thickness of 9 μm instead of 15 μm.

Example 12

An electrophotographic photoreceptor was manufactured in substantially the same manner as that used in Example 1 except that a protection layer was formed so as to have a thickness of 21 μm instead of 15 μm.

Example 13

An electrophotographic photoreceptor was manufactured in substantially the same manner as that used in Example 9 except that a protection layer was formed so as to have a thickness of 9 μm instead of 15 μm.

Example 14

An electrophotographic photoreceptor was manufactured in substantially the same manner as that used in Example 10 except that a protection layer was formed so as to have a thickness of 21 μm instead of 15 μm.

Example 15

An electrophotographic photoreceptor was manufactured in substantially the same manner as that used in Example 13 except that a protection layer coating solution was prepared using Exemplified Compound 1-4 instead of Exemplified Compound 1-1.

Example 16

An electrophotographic photoreceptor was manufactured in substantially the same manner as that used in Example 14 except that a protection layer coating solution was prepared using Exemplified Compound 1-4 instead of Exemplified Compound 1-1.

Example 17

An electrophotographic photoreceptor was manufactured in substantially the same manner as that used in Example 15 except that a protection layer coating solution was prepared using Exemplified Compound 2-17 instead of Exemplified Compound 2-15.

Example 18

An electrophotographic photoreceptor was manufactured in substantially the same manner as that used in Example 16 except that a protection layer coating solution was prepared using Exemplified Compound 2-17 instead of Exemplified Compound 2-15.

Comparative Example 1

An electrophotographic photoreceptor was manufactured in substantially the same manner as that used in Example 1 except that a protection layer coating solution was prepared without using Exemplified Compound 1-1.

Comparative Example 2

An electrophotographic photoreceptor was manufactured in substantially the same manner as that used in Example 1 except that a protection layer coating solution was prepared using a compound represented by the following formula instead of Exemplified Compound 1-1:

(C-1)

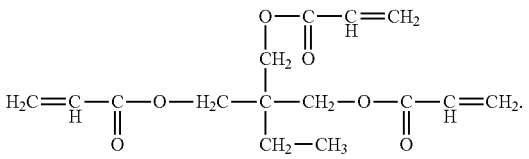

Evaluation

The electrophotographic photoreceptor manufactured in each of Examples 1 to 18 and Comparative Examples 1 and 2 was fitted to a cyan station which was used as an evaluation apparatus and which was a modification of an electrophotographic apparatus (copier), iR-ADV C5255, available from CANON KABUSHIKI KAISHA. The electrophotographic photoreceptor was evaluated for environmental change under conditions below.

Environmental Change Evaluation

The change in potential of the electrophotographic photoreceptor was investigated in such a manner that an image was continuously formed on 1,000 sheets of A4 size paper using a test chart with an image ratio of 1% in each of a high-temperature, high-humidity environment of 30° C. and 80% RH and a low-temperature, low-humidity environment of 15° C. and 5% RH. The value of "potential after 1,000 sheets−initial potential" of an image exposure section VL was denoted by ΔVL.

Next, the value of "ΔVL(HH)−ΔVL(LL)" was calculated as a result of an environmental change, where ΔVL(HH) is ΔVL in the high-temperature, high-humidity environment and ΔVL(LL) is ΔVL in the low-temperature, low-humidity environment.

In the present disclosure, characteristics of an electrophotographic photoreceptor were judged not problematic when the environmental change "ΔVL(HH)−ΔVL(LL)" was less than 10 V and ΔVL(HH) and ΔVL(LL) were less than 30 V.

TABLE

| | Compound represented by formula (1) | | Compound represented by formula (2) | | Thickness of protection layer (μm) | Additive | Electric potential change (V) ΔVL(HH) | Electric potential change (V) ΔVL(LL) | Environmental change (V) ΔVL(HH) − ΔVL(LL) |
|---|---|---|---|---|---|---|---|---|---|
| Example 1 | Exemplified Compound 1-1 | 21 parts | Exemplified Compound 2-15 | 49 parts | 15 | PTFE | 10.5 | 9.1 | 1.4 |
| Example 2 | Exemplified Compound 1-1 | 21 parts | Exemplified Compound 2-17 | 49 parts | 15 | PTFE | 12.8 | 9.7 | 3.1 |
| Example 3 | Exemplified Compound 1-1 | 14 parts | Exemplified Compound 2-15 | 56 parts | 15 | PTFE | 10.4 | 8.7 | 1.7 |
| Example 4 | Exemplified Compound 1-1 | 28 parts | Exemplified Compound 2-15 | 42 parts | 15 | PTFE | 11.5 | 10.3 | 1.2 |
| Example 5 | Exemplified Compound 1-1 | 13 parts | Exemplified Compound 2-15 | 57 parts | 15 | PTFE | 11.7 | 8.5 | 3.2 |
| Example 6 | Exemplified Compound 1-1 | 29 parts | Exemplified Compound 2-15 | 41 parts | 15 | PTFE | 12.1 | 11.0 | 1.1 |
| Example 7 | Exemplified Compound 1-4 | 21 parts | Exemplified Compound 2-15 | 49 parts | 15 | PTFE | 12.3 | 9.3 | 3.0 |
| Example 8 | Exemplified Compound 1-1 | 21 parts | Exemplified Compound 2-15 | 49 parts | 15 | — | 12.2 | 8.8 | 3.4 |
| Example 9 | Exemplified Compound 1-1 | 13 parts | Exemplified Compound 2-15 | 57 parts | 15 | — | 13.7 | 8.4 | 5.3 |
| Example 10 | Exemplified Compound 1-1 | 29 parts | Exemplified Compound 2-15 | 41 parts | 15 | — | 15.7 | 12.8 | 2.9 |
| Example 11 | Exemplified Compound 1-1 | 21 parts | Exemplified Compound 2-15 | 49 parts | 9 | PTFE | 11.6 | 8.0 | 3.6 |
| Example 12 | Exemplified Compound 1-1 | 21 parts | Exemplified Compound 2-15 | 49 parts | 21 | PTFE | 14.2 | 13.1 | 1.1 |
| Example 13 | Exemplified Compound 1-1 | 13 parts | Exemplified Compound 2-15 | 57 parts | 9 | — | 13.5 | 7.8 | 5.7 |
| Example 14 | Exemplified Compound 1-1 | 29 parts | Exemplified Compound 2-15 | 41 parts | 21 | — | 17.9 | 15.2 | 2.7 |
| Example 15 | Exemplified Compound 1-4 | 13 parts | Exemplified Compound 2-15 | 57 parts | 9 | — | 15.3 | 8.0 | 7.3 |
| Example 16 | Exemplified Compound 1-4 | 29 parts | Exemplified Compound 2-15 | 41 parts | 21 | — | 20.6 | 15.1 | 5.5 |
| Example 17 | Exemplified Compound 1-4 | 13 parts | Exemplified Compound 2-17 | 57 parts | 9 | — | 16.9 | 8.7 | 8.2 |
| Example 18 | Exemplified Compound 1-4 | 29 parts | Exemplified Compound 2-17 | 41 parts | 21 | — | 23.2 | 15.7 | 7.5 |
| Comparative Example 1 | Not used | | Exemplified Compound 2-15 | 49 parts | 15 | PTFE | 19.4 | 7.4 | 12.0 |
| Comparative Example 2 | Comparative Compound C-1 | 21 parts | Exemplified Compound 2-15 | 49 parts | 15 | PTFE | 22.0 | 9.5 | 12.5 |

As a result of evaluation, in the electrophotographic photoreceptors manufactured in Examples 1 to 18, an environmental change during repetitive use could be sufficiently suppressed and there was no problem. In the electrophotographic photoreceptors manufactured in Comparative Examples 1 and 2, there was a problem with an environmental change.

As described above with reference to the examples and the comparative examples, according to the present disclosure, an electrophotographic photoreceptor capable of suppressing an environmental change during repetitive use can be provided. Furthermore, according to the present disclosure, a process cartridge including the electrophotographic photoreceptor and an electrophotographic apparatus can be provided.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-034907, filed Feb. 27, 2019, which is hereby incorporated by reference herein in its entirety.

What is claimed is:

1. An electrophotographic photoreceptor comprising: in series, a support;

a photosensitive layer; and a protection layer, wherein the protection layer contains a copolymer of a composition containing a compound represented by the following formula (1) and a compound represented by the following formula (2):

(1)

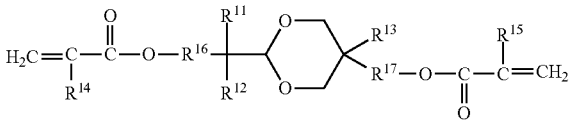

in formula (1), $R^{11}$ and $R^{12}$ each independently represent an alkyl group having one to four carbon atoms and optionally bonded to each other to form a ring, $R^{13}$ represents an alkyl group having one to four carbon atoms, $R^{14}$ and $R^{15}$ each independently represent a hydrogen atom or a methyl group, and $R^{16}$ and $R^{17}$ each independently represent an alkylene group having one to four carbon atoms, (2)

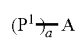

in formula (2), A represents a hole-transporting group, $P^1$ represents an monovalent functional group represented by the following formula (3) or (4), a represents an integer of 1 to 4, and $P^1$ represents the same group or different groups represented by the following formula (3) or (4) when a is an integer of 2 to 4:

(3)

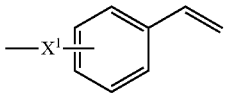

in formula (3), $X^1$ represents a (n+1)valent linking group formed by combining two or more selected from the group consisting of an alkylene group, —C(=O)—, —N(L)-, —S—, and —O— and is bonded to $P^1$ in formula (2), and in N(L)-, L represents a hydrogen atom, an alkyl group, an aryl group, or an aralkyl group, (4)

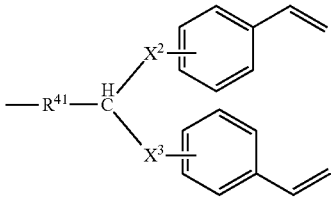

in formula (4), $R^{41}$ represents an alkylene group and is bonded to $P^1$ in formula (2); $X^2$ and $X^3$ represent a (n+1) valent linking group formed by combining two or more selected from the group consisting of an alkylene group, —C(=O)—, —N(L)-, —S—, and —O— and are the same as or different from each other; and in N(L)-, L represents a hydrogen atom, an alkyl group, an aryl group, or an aralkyl group, and a compound obtained by substituting an hydrogen atom for a moiety of A that is bonded to $P^1$ in formula (2) being represented by the following formula (5) or (6):

(5)

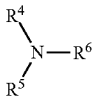

in formula (5), $R^4$, $R^5$, and $R^6$ represent a phenyl group, biphenyl group, or fluorenyl group that optionally have an alkyl group having one to six carbon atoms and $R^4$, $R^5$, and $R^6$ are the same as or different from each other, (6)

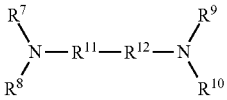

in formula (6), $R^7$, $R^8$, $R^9$, $R^{10}$, $R^{11}$, and $R^{12}$ represent a phenyl group that optionally have an alkyl group having one to six carbon atoms and $R^7$, $R^8$, $R^9$, $R^{10}$, $R^{11}$, and $R^{12}$ are the same as or different from each other.

2. The electrophotographic photoreceptor according to claim 1, wherein $P^1$ in formula (2) is a monovalent functional group represented by any one of the following formulas (7), (8), (9), and (10):

(7)

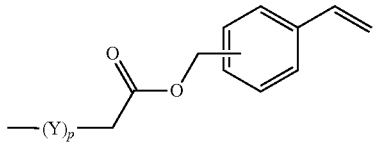

in formula (7), Y represents a divalent organic group and p represents an integer of 0 or 1, (8)

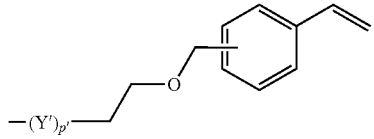

in formula (8), Y' represents a divalent organic group and p' represents an integer of 0 or 1, (9)

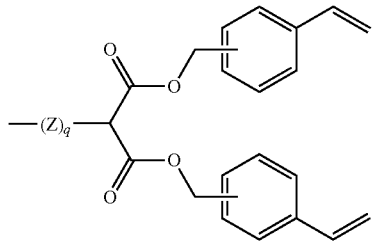

in formula (9), Z represents a divalent organic group and q represents an integer of 0 or 1, (10)

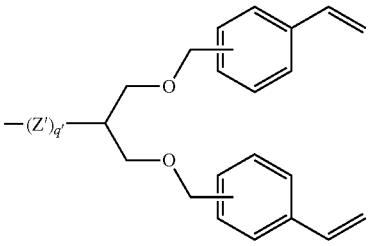

in formula (10), Z' represents a divalent organic group and q' represents an integer of 0 or 1.

3. The electrophotographic photoreceptor according to claim 1, wherein the content of the compound represented by formula (1) in the composition is 25.0% by mass to 66.7% by mass with respect to the compound represented by formula (2).

4. The electrophotographic photoreceptor according to claim 1, wherein $R^{11}$ and $R^{12}$ in the compound represented by formula (1) are a methyl group.

5. The electrophotographic photoreceptor according to claim 1, wherein the protection layer contains polytetrafluoroethylene particles.

6. The electrophotographic photoreceptor according to claim 1, wherein the protection layer has an average thickness of 10 μm to 20 μm.

7. A process cartridge comprising:

the electrophotographic photoreceptor and at least one selected from the group consisting of a charging unit, a developing unit, a transfer unit, and a cleaning unit integrally supported, the process cartridge being attachable to or detachable from a main body of an electrophotographic photoreceptor and wherein the electrophotographic photoreceptor comprising: in series, a support;

a photosensitive layer; and a protection layer, wherein the protection layer contains a copolymer of a composition containing a compound represented by the following formula (1) and a compound represented by the following formula (2):

(1)

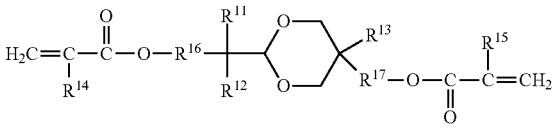

in formula (1), $R^{11}$ and $R^{12}$ each independently represent an alkyl group having one to four carbon atoms and optionally bonded to each other to form a ring, $R^{13}$ represents an alkyl group having one to four carbon atoms, $R^{14}$ and $R^{15}$ each independently represent a hydrogen atom or a methyl group, and $R^{16}$ and $R^{17}$ each independently represent an alkylene group having one to four carbon atoms, (2)

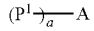

in formula (2), A represents a hole-transporting group, $P^1$ represents an monovalent functional group represented by the following formula (3) or (4), a represents an integer of 1 to 4, and $P^1$ represents the same group or different groups represented by the following formula (3) or (4) when a is an integer of 2 to 4:

(3)

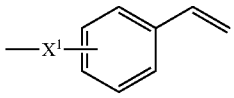

in formula (3), $X^1$ represents a (n+1)valent linking group formed by combining two or more selected from the group consisting of an alkylene group, —C(=O)—, —N(L)-, —S—, and —O— and is bonded to $P^1$ in formula (2), and in N(L)-, L represents a hydrogen atom, an alkyl group, an aryl group, or an aralkyl group, (4)

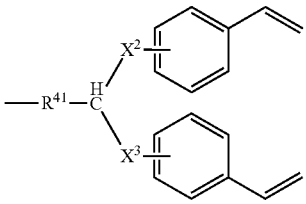

in formula (4), $R^{41}$ represents an alkylene group and is bonded to $P^1$ in formula (2); $X^2$ and $X^3$ represent a (n+1) valent linking group formed by combining two or more selected from the group consisting of an alkylene group, —C(=O)—, —N(L)-, —S—, and —O— and are the same as or different from each other; and in N(L)-, L represents a hydrogen atom, an alkyl group, an aryl group, or an aralkyl group, and a compound obtained by substituting an hydrogen atom for a moiety of A that is bonded to $P^1$ in formula (2) being represented by the following formula (5) or (6):

(5)

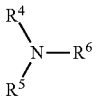

in formula (5), $R^4$, $R^5$, and $R^6$ represent a phenyl group, biphenyl group, or fluorenyl group that optionally have an alkyl group having one to six carbon atoms and $R^4$, $R^5$, and $R^6$ are the same as or different from each other, (6)

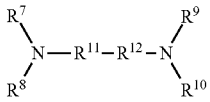

in formula (6), $R^7$, $R^8$, $R^9$, $R^{10}$, $R^{11}$, and $R^{12}$ represent a phenyl group that optionally have an alkyl group having one to six carbon atoms and $R^7$, $R^8$, $R^9$, $R^{10}$, $R^{11}$, and $R^{12}$ are the same as or different from each other.

8. An electrophotographic apparatus comprising:

the electrophotographic photoreceptor; and at least one selected from the group consisting of a charging unit, an exposure unit, a developing unit, and a transfer unit and wherein the electrophotographic photoreceptor comprising: in series, a support;

a photosensitive layer; and a protection layer, wherein the protection layer contains a copolymer of a composition containing a compound represented by the following formula (1) and a compound represented by the following formula (2):

(1)

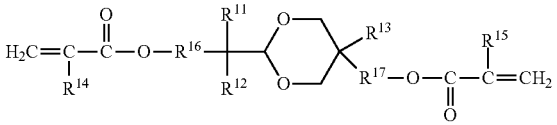

in formula (1), $R^{11}$ and $R^{12}$ each independently represent an alkyl group having one to four carbon atoms and optionally bonded to each other to form a ring, $R^{13}$ represents an alkyl group having one to four carbon atoms, $R^{14}$ and $R^{15}$ each independently represent a hydrogen atom or a methyl group, and $R^{16}$ and $R^{17}$ each independently represent an alkylene group having one to four carbon atoms, (2)

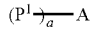

in formula (2), A represents a hole-transporting group, $P^1$ represents an monovalent functional group represented by the following formula (3) or (4), a represents an integer of 1 to 4, and $P^1$ represents the same group or different groups represented by the following formula (3) or (4) when a is an integer of 2 to 4:

(3)

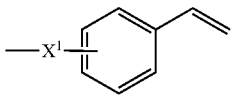

in formula (3), $X^1$ represents a (n+1)valent linking group formed by combining two or more selected from the group consisting of an alkylene group, —C(=O)—, —N(L)-, —S—, and —O— and is bonded to $P^1$ in formula (2), and in N(L)-, L represents a hydrogen atom, an alkyl group, an aryl group, or an aralkyl group, (4)

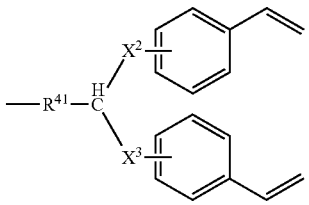

in formula (4), $R^{41}$ represents an alkylene group and is bonded to $P^1$ in formula (2); $X^2$ and $X^3$ represent a (n+1) valent linking group formed by combining two or more selected from the group consisting of an alkylene group, —C(=O)—, —N(L)-, —S—, and —O— and are the same as or different from each other; and in N(L)-, L represents a hydrogen atom, an alkyl group, an aryl group, or an aralkyl group, and a compound obtained by substituting an hydrogen atom for a moiety of A that is bonded to $P^1$ in formula (2) being represented by the following formula (5) or (6):

(5)

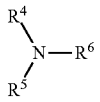

in formula (5), $R^4$, $R^5$, and $R^6$ represent a phenyl group, biphenyl group, or fluorenyl group that optionally have an alkyl group having one to six carbon atoms and $R^4$, $R^5$, and $R^6$ are the same as or different from each other, (6)

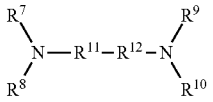

in formula (6), $R^7$, $R^8$, $R^9$, $R^{10}$, $R^{11}$, and $R^{12}$ represent a phenyl group that optionally have an alkyl group having one to six carbon atoms and $R^7$, $R^8$, $R^9$, $R^{10}$, $R^{11}$, and $R^{12}$ are the same as or different from each other.

* * * * *